US005145097A

United States Patent [19]

Lowe

[11] Patent Number: 5,145,097

[45] Date of Patent: Sep. 8, 1992

[54] SALT SHAKER DEVICE WITH A RESILIENT COVER RETAINING DEVICE

[76] Inventor: John P. Lowe, 1020 Prospect St., Apartment 303, Lansing, Mich. 48912

[21] Appl. No.: 793,579

[22] Filed: Nov. 18, 1991

[51] Int. Cl.[5] ..... A47G 19/24

[52] U.S. Cl. ..... 222/543; 220/375; 222/565

[58] Field of Search ..... 222/142.1, 480, 543, 222/562, 565; 220/246, 375; 215/306

[56] References Cited

U.S. PATENT DOCUMENTS

| | | | |
|---|---|---|---|
| D. 237,576 | 11/1975 | Cyren . | |
| 553,580 | 1/1896 | Frye | 222/142.1 |
| 595,481 | 12/1897 | Jenatschke et al. . | |
| 994,943 | 6/1911 | Luchsinger | 222/543 X |
| 1,154,829 | 9/1915 | Ainslie | 222/543 X |
| 1,201,196 | 10/1916 | Kizer | 222/543 X |
| 1,264,134 | 4/1918 | Quick . | |
| 1,366,854 | 1/1921 | Warren | 220/375 X |
| 1,439,259 | 12/1922 | Pasnik . | |
| 2,332,768 | 10/1943 | Wilcox | 222/565 |
| 2,695,732 | 11/1954 | Tupper | 222/480 UX |
| 2,974,887 | 1/1960 | Grandinetti . | |
| 3,042,270 | 7/1962 | Stearns | 222/543 X |
| 3,476,297 | 11/1969 | Swett et al. | 222/480 |
| 3,485,416 | 12/1969 | Fohrman . | |
| 3,964,194 | 6/1976 | Gugeler | 220/246 X |
| 4,106,672 | 8/1978 | Tecco et al. | 222/543 X |

FOREIGN PATENT DOCUMENTS

| | | | |
|---|---|---|---|
| 508279 | 12/1954 | Canada | 222/142.1 |
| 1040968 | 10/1953 | France | 222/543 |
| 427507 | 11/1947 | Italy | 220/375 |
| 411579 | 6/1934 | United Kingdom | 220/375 |

*Primary Examiner*—Kevin P. Shaver
*Attorney, Agent, or Firm*—Ian C. McLeod

[57] ABSTRACT

A food seasoning shaker (10) for dispensing salt and the like, is described. The shaker is comprised of a container portion (11) for holding food seasoning (13), a cover portion (15) serving as a closure for the container, a pair of anchor rods (17) and (19) mounted on annular rims (11F) and (15G) on the respective container and cover and a connection spring (21) mounted on and between the rods for holding the cover on the container. The cover has a top wall (15B) with perforations or openings (15D) for dispensing food seasoning from the shaker. The anchor rods and connecting spring enable the cover to rotate about the axis of the shaker with respect to the container portion. The anchor rods and connecting spring also enable the cover to partially separate from the container for filling the shaker with food seasoning.

12 Claims, 3 Drawing Sheets

SALT SHAKER DEVICE WITH A RESILIENT COVER RETAINING DEVICE

Figure 1:
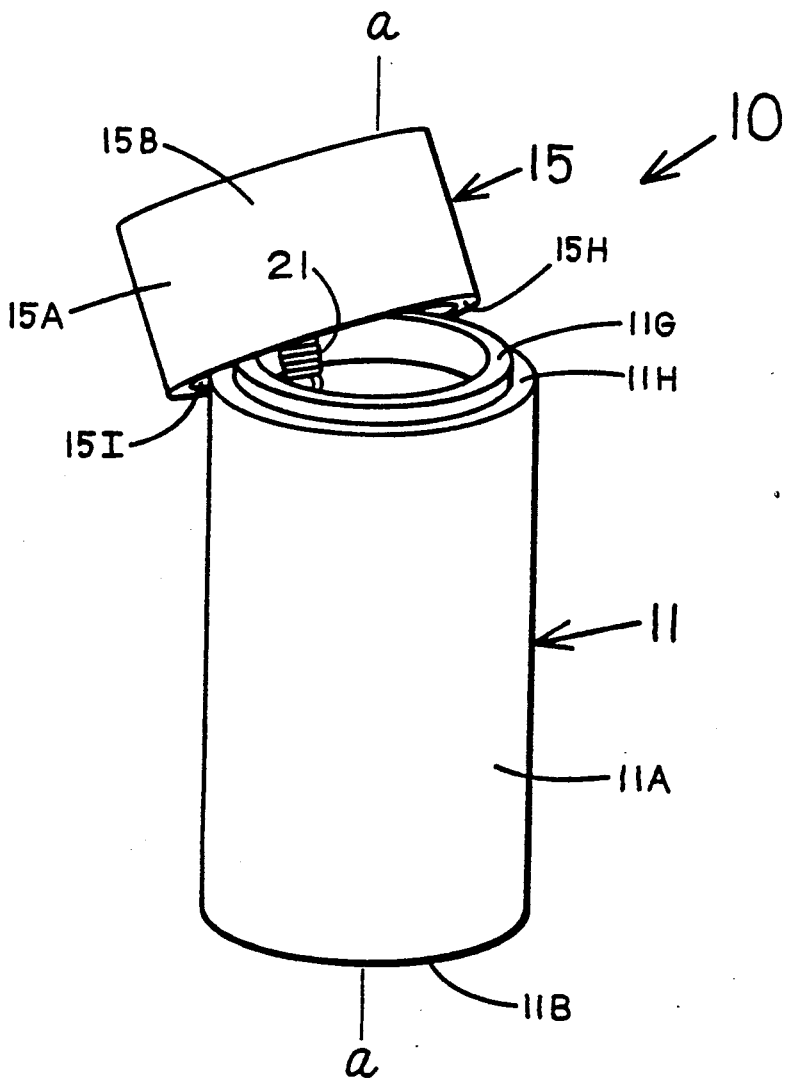

BACKGROUND OF THE INVENTION (1) Field of the Invention

The present invention relates to a dispenser for food seasoning. In particular, the present invention relates to a food seasoning shaker or dispenser having a cover portion partially separable from a container portion for holding food seasoning. The cover is preferably held on the container by a holding means comprising a pair of anchor rods and a connecting spring. The rods are mounted on respective annular rims on the inside walls of the cover and the container. The spring is connected between the anchor rods to bias the cover on the container as a closure for the container. The holding means enables the cover to be rotated around the longitudinal axis of the dispenser, relative to the container portion with the anchor rods rotating around the axis on the respective annular rims. The cover also has a perforated end wall for dispensing food seasoning such as salt and the like from the dispenser. When the food seasoning becomes depleted, the connecting spring enables the cover to be partially separated from the container for filling the dispenser with food seasoning. As used herein the term "food seasoning" relates to any ingredient such as salt, pepper or other spices that are added to food primarily for the savor that the seasoning imparts to the food.

(2) Prior Art

The prior art has described various types of containers as dispensers and shakers for dispensing food seasoning. Some of the prior art devices describe combination dispensers having a salt shaker and a pepper mill mounted together along a longitudinal axis of the dispenser. These prior art devices use a variety of methods for filling the dispensers with food seasoning. Illustrative of the prior art food seasoning dispensers are U.S. Pat. Nos. 595,481 to Jenatschke & Fischer; 1,264,134 to Quick; 2,974,887 to Grandinetti; 3,485,416 to Fohrman and U.S. Des. Pat. No. 237,576 to Cyren.

U.S Pat. No. 1,439,259 to Pasnik describes a salt dispenser having a valved bottom with a removeable cover. The shaker has a main salt receptacle having an opening at the bottom of the receptacle. A moveable plug or valve is mounted on a-central spindle and is seated in the bottom opening of the receptacle. A top portion of the spindle extends through an inverted cup, centrally mounted inside of a cover for the receptacle. A spring is mounted in the cup around the spindle and biases against a plunger mounted on an upper end of the spindle. Depressing the plunger causes the spindle to move the plug away from the receptacle to release salt from the bottom opening of the receptacle. The spring also enables the cover to be partially separated from the receptacle for filling the receptacle from the top. However, during filling, there is a tendency for the plug to move out of the receptacle and spill salt if the shaker is not completely empty.

What is needed is a unitary dispenser as a shaker for food seasoning such as salt and the like, which allows for filling the dispenser with food seasoning without having to align filler openings and without having to completely separate part of the dispenser. The problem with aligning filler openings is that a build-up of food seasoning accumulates between the rotatable members having the filler openings. This build-up eventually wears the rotatable members, causing them to become loose. Also, the filler openings are usually relatively small which makes it difficult to fill through the opening without spilling food seasoning. Those devices that require part of the dispenser to be disassembled for filling, risk having the disassembled parts becoming lost Furthermore, the devices that use pins or rods in place to hold the cover on the container are not preferred. The stationary pins require the use of a tool, such as a punch, to drift the pins out of the cover and the container for accessing the pins for cleaning and the like. The present invention solves this problem by enabling the anchor rods to be unseated from the annular rims to remove the rods from the cover and the container.

OBJECTS

It is therefore an object of the present invention to provide a food seasoning dispenser as a shaker which has a cover portion with a perforated end wall mounted on a container portion holding the food seasoning, wherein the cover is partially separable from the container for filling the dispenser. Further, it is an object of the present invention to provide a dispenser for food seasoning having a pair of anchor rods mounted on inner annular ledges on the inside of the respective cover and container and, which anchor rods are connected by a spring to hold the cover on the container so that the cover is partially separable from the container for filling the dispenser. Finally, it is an object of the present invention to provide a dispenser for food seasoning that is inexpensive to manufacture and simple to assemble and use. These and other objects will become increasingly apparent by reference to the following descriptions and to the drawings.

IN THE DRAWINGS

FIG. 1 is a perspective view of the food seasoning shaker 10 of the present invention with a cover 15 mounted on and partially separated from a container 11 for filling the shaker 10.

Figure 2:
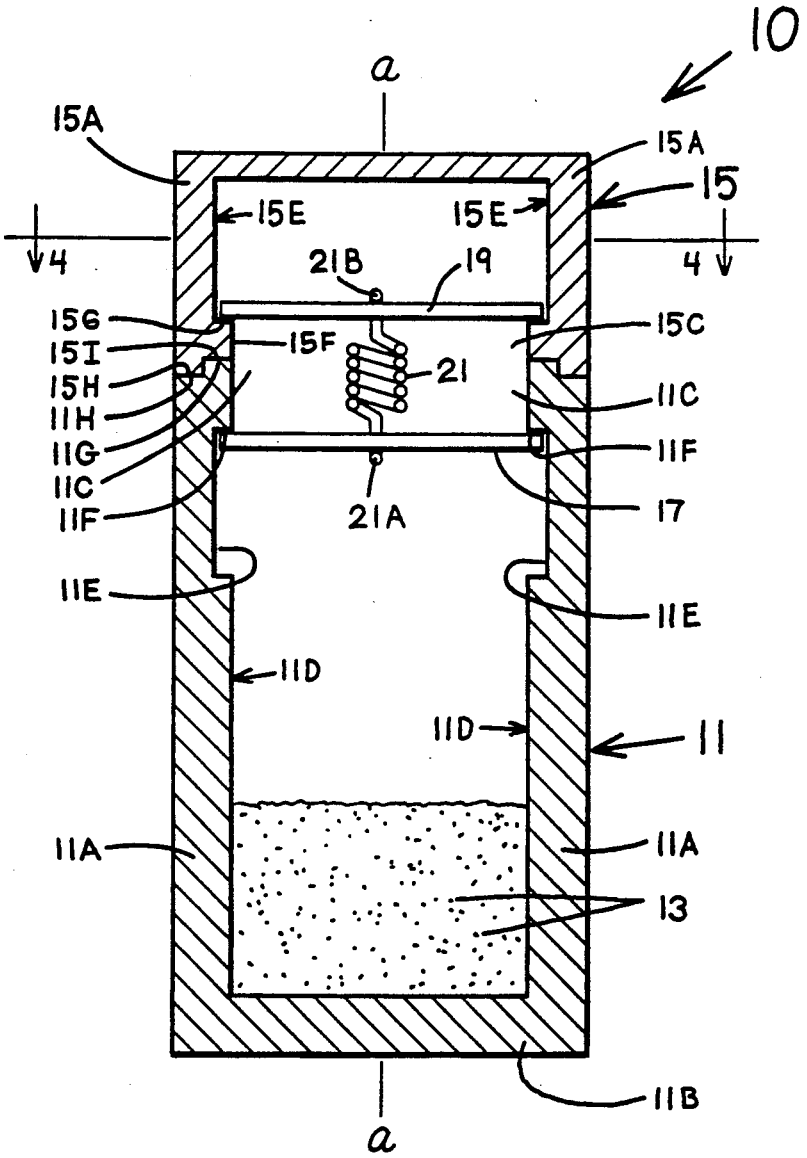

FIG. 2 is a cross-sectional view of the food seasoning shaker 10 shown in FIG. 1 particularly showing the cover 15 held on the container 11 by anchor rods 17 and 19 with connecting spring 21.

Figure 2A:
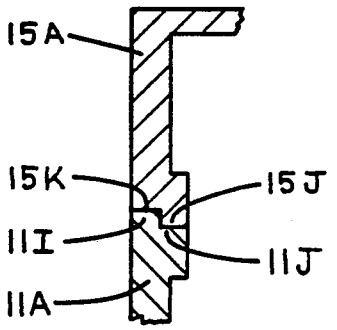
Figure 2B:
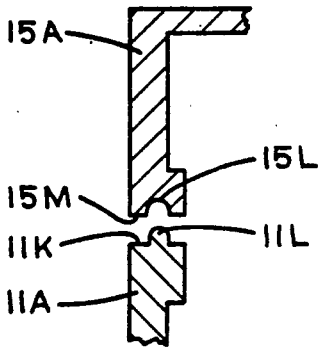

FIGS. 2A and 2B are partial cross-sectional views of different embodiments for mating the cover 15 on the container 11.

Figure 3:
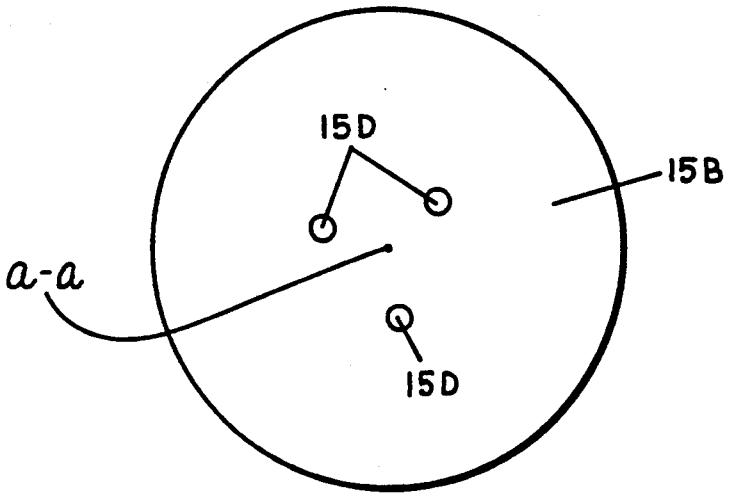

FIG. 3 is a top plan view of the food seasoning shaker 10 shown in FIG. 1 particularly showing the top wall 13D of the cover 13 with openings or perforations 15D for dispensing food seasoning from the shaker 10.

Figure 4:
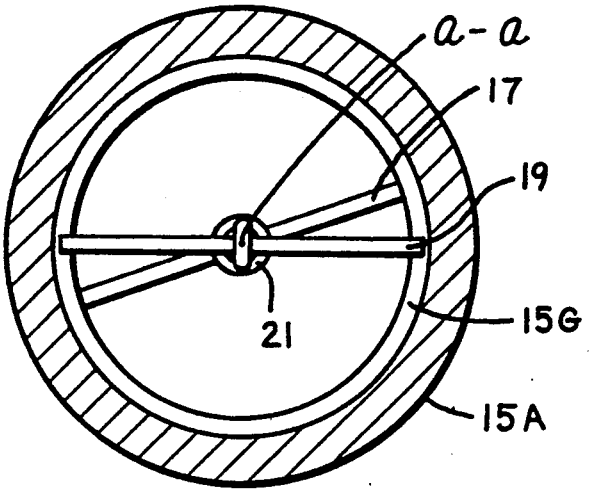

FIG. 4 is a cross-sectional view along line 4—4 of FIG. 2 showing the anchor rods 17 and 19 and connecting spring 21.

GENERAL DESCRIPTION

The present invention relates to an elongate dispenser for food seasoning which comprises: a container portion having a sidewall extending along and around a longitudinal axis of the dispenser from a bottom wall to an open end of the container portion; a cover means for the container portion, the cover means having a perforated end wall and being spaced from the container portion for dispensing food seasoning from the dispenser and with an open end of the cover means, removeably mounted on the open end of the container portion to form a closure for the container portion; a first, anchor means mounted across the longitudinal axis on an inner annular rim of the cover means; a second anchor means mounted across the longitudinal axis on an inner annular rim of the container; and a resilient holding means mounted on and between the first and the second anchor means to hold the cover means on the open end of the container portion as the closure for the container portion, wherein the holding means provides for rotational movement of the cover means relative to the container portion with the first and second anchor means rotating around the longitudinal axis on the respective first and second annular rims and wherein the holding means provides for movement of the cover means and the first anchor means along the longitudinal axis to remove the cover means from the open end of the container portion, and preferably for relative movement between the holding means and the first and second anchor means, so that the cover means is partially separable from the container portion to permit filling the dispenser with food seasoning.

The container and the cover for the dispenser can be made of plastic, wood, metal, glass, stone or other like materials. The anchor rods are preferably metal and circular in cross-section, although other rigid materials are contemplated by the scope of the present invention. Also, while a coil spring is preferred as the spring means that holds the cover on the container, the spring means can be provided by a leaf spring, an elastic member or any other spring means that would suitably connect between the two anchor rods.

SPECIFIC DESCRIPTION

The food seasoning shaker 10 of the present invention is shown in perspective in FIG. 1. As shown particularly in cross-section in FIG. 2, the shaker 10 comprises a container portion 11 for holding a food seasoning 13, a cover 15 for the container 11, a first anchor rod 17 mounted in the container 11, a second anchor rod 19 mounted in the cover 15 and a spring 21 connected between the rods 17 and 19 to bias the cover 15 on the container 11. The food seasoning 13 is preferably salt or the like.

The container 11 has a circular cross-section along and around a longitudinal axis a—a and is formed by a cylindrical sidewall 11A extending from a bottom wall 11B. The sidewall 11A extends to an open upper end 11C of the sidewall 11A. An inner surface 11D of the sidewall 11A has an annular groove 11E, spaced below the open end 11C of the container 11. The groove 11E extends around and along the longitudinal axis a—a to form an annular rim or ledge 11F spaced from the open end 11C.

The cover 15 has a circular cross-section along and around the longitudinal axis a—a and mounts on the container 11 to close the open end 11C of the container 11. The cover 15 has a cylindrical sidewall 15A extending along the axis a—a from a top wall 15B to an open lower end 15C of the sidewall 15A. The top wall 15B is provided with a plurality of openings or perforations 15D (FIG. 3) for dispensing food seasoning 13 and the like from the shaker apparatus 10. An inner surface 15E of the sidewall 15A has an annular protrusion 15F adjacent to the open end 15C of the cover 15. The protrusion 15F forms an annular rim or ledge 15G spaced from the open end 15C of the cover 15.

As shown in FIG. 2, the annular groove 11E in the sidewall 11A of the container 11 provides for mounting the first anchor rod 17. Rod 17 preferably has a circular cross-section along the length of the rod 17 and mounts on the annular ledge 11F, across the axis a—a (FIG. 4). The present invention contemplates that the rod 17 need not necessarily have a circular cross-section, but instead, the rod 17 can have various cross-sectional shapes. What is important is that the rod 17 mounts on the annular ledge 11F and serves as an anchor for one end 21A of the spring 21.

Similarly, the annular groove 15G in the sidewall 15A of the cover 15 provides for mounting the second anchor rod 19. Rod 19 preferably has a circular cross-section along the length of the rod 19 and mounts on the annular ledge 15G across the axis a—a (FIG. 4). However, in a similar manner as rod 17, rod 19 need not necessarily have a circular cross-section along the rod 19. Instead, rod 19 can have various cross-sectional shapes. Rod 19 serves as an anchor for a second end 21B of spring 21.

The sidewall 11A of the container 11 has an inner annular protrusion 11G at an upper end of the sidewall 11A, adjacent the open end 11C of the container 11. Protrusion 11G forms an outer annular ledge 11H spaced radially outwardly along the axis a—a from the protrusion 11G. Similarly, the sidewall 15A of the cover 15 has an outer annular protrusion 15H at a lower end of the sidewall 15A, adjacent the open end 15C of the cover 15. Protrusion 15H forms an inner annular ledge 15I, spaced radially inwardly along the axis a—a from the protrusion 15H.

Spring 21 mounts on the rods 17 and 19 and serves to hold the cover 15 on the container 11. In this position, the annular protrusion 11G of container 11 mates with the annular ledge 151 of cover 15 and the annular protrusion 15H of cover 15 mates with the annular ledge 11H of container 11. That way, the cover 15 is held on the container 11 by the rods 17 and 19, and the spring 21 to form a closure for the open end 11C of the container 11. It should be understood that spring 21 can also be a resilient means as an elastic member or a flat spring mounted between the rods 17 and 19. What is important is that resilient spring 21 holds the cover 15 on the container 11 and allows the cover 15 and the container 11 to rotate about the axis a—a with respect to each other.

FIG. 2A shows another embodiment for mating the cover 15 with the container 11. In this embodiment, the sidewall 11A of the container 11 has an outer annular protrusion 11I at an upper end of the sidewall 11A. Protrusion 11I forms an inner annular ledge 11J, spaced radially inwardly from the protrusion 11I. The sidewall 15A of the cover 15 has an inner annular protrusion 15J at a lower end of the sidewall 15A. Protrusion 15J forms an outer annular ledge 15K, spaced radially outwardly from the protrusion 15J. In the closed position, similar to that shown in FIG. 1, the annular protrusion 11I of container 11 mates with the annular ledge 15K of cover 15 and the annular protrusion 15J mates with the annular ledge 11J of container 11. This embodiment enables the food seasoning shaker 10 to be filled with food seasoning 13 in a similar manner as that hereinafter described with respect to FIGS. 1 and 2.

FIG. 2B shows still another embodiment for mating the cover 15 with the container 11. The upper edge 11K of the sidewall 11A of the container 11 is provided with a tongue 11L that mates with a groove 15L provided on the lower edge 15M of the sidewall 15A of the cover 15, when the food seasoning shaker 10 is in the closed position, similar to that shown in FIG. 2. It should be understood that the sidewall 11A of the container 11 can be provided with the groove and that the sidewall 15A of the cover 15 can be provided with the tongue. This embodiment also enables the food seasoning shaker 10 to be filled with seasoning 13 in a similar manner as that hereinafter described with respect to FIGS. 1 and 2.

In use, the container 11 is filled with the food seasoning 13 and the cover 15 is mounted on the container 11 to form a closure for the open end 11C of the container 11. A user of the shaker apparatus 10 holds the shaker 10 with the container 11 above the cover 15. This causes the food seasoning 13 to move into the cover 15 and to move through the openings 15D in the top wall 15B of the cover 15 for seasoning food.

When the supply of food seasoning 13 in the container 11 becomes depleted, the shaker 10 can be refilled. As shown in FIG. 1, this is done by grasping the cover 15 and moving the cover 15 axially along the axis a—a, away from the container 11 until the annular protrusion 11G of container 11 is completely out of the annular ledge 15l of the cover 15. The cover 15 can then be partially separated from the container 11 with the spring 21 sliding with respect to the rods 17 and 19 to a position askew from the axis a—a. The container 11 is then able to be filled with food seasoning 13. After the container 11 is filled with food seasoning 13, the cover 15 is then reassembled back on the container 11 to form the shaker 10.

It is intended that the foregoing description be only illustrative of the present invention and that the present invention be limited only by the hereinafter appended claims.

I claim:

1. An elongate dispenser for food seasoning which comprises:

(a) a container portion having a sidewall extending along and around a longitudinal axis of the dispenser from a bottom wall to an open end of the container portion;

(b) a cover means for the container portion, the cover means having a perforated end wall and being spaced from the container portion for dispensing food seasoning from the dispenser and with an open end of the cover means, removeably mounted on the open end of the container portion to form a closure for the container portion;

(c) a first, anchor means mounted across the longitudinal axis on an inner annular rim of the cover means;

(d) a second anchor means mounted across the longitudinal axis on an inner annular rim of the container; and (e) a resilient holding means mounted on and between the first and the second anchor means to hold the cover means on the open end of the container portion as the closure for the container portion, wherein the holding means provides for rotational movement of the cover means relative to the container portion with the first and second anchor means rotating around the longitudinal axis on the respective first and second annular rims and wherein the holding means provides for movement of the cover means and the first anchor means along the longitudinal axis to remove the cover means from the-open end of the container portion so that the cover means is partially separable from the container portion to permit filling the dispenser with food seasoning.

2. The dispenser of claim 1 wherein the container portion is a cylindrical shaped member having a circular cross-section perpendicular to the longitudinal axis with the sidewall extending from an outer periphery of the bottom wall of the container portion to the open end of the container portion and wherein the cover means is a cylindrical shaped member having a circular cross-section perpendicular to the longitudinal axis with a sidewall extending from an outer periphery of the perforated end wall of the cover means to the open end of the cover means mounted on the open end of the container portion.

3. The dispenser of claim 2 wherein the sidewall of the container portion has an outer annular ridge at the open end of the container portion and wherein the sidewall of the cover means has an inner annular ridge at a lower end of the sidewall, spaced from the perforated end wall, wherein the annular ridge of the cover means mounts on and radially outside of the annular ridge of the container portion so that the cover means forms a closure for the open end of the container portion of the dispenser.

4. The dispenser of claim 2 wherein the sidewall of the container portion has an inner annular ridge at the open end of the container portion and wherein the sidewall of the cover means has an outer annular ridge at a lower end of the sidewall, spaced from the perforated end wall, wherein the annular ridge of the cover means mounts on and radially inside of the annular ridge of the container portion so that the cover means forms a closure for the open end of the container portion of the dispenser.

5. The dispenser of claim 2 wherein the sidewall of the container portion has an annular tongue at the open end of the container portion and wherein the sidewall of the cover means has an annular groove at a lower end of the sidewall, spaced from the perforated end wall, wherein the annular tongue of the container portion mates with the annular groove of the cover means so that the cover means forms a closure for the open end of the container portion of the dispenser.

6. The dispenser of claim 2 wherein the first and the second anchor means are a first and second rod means having opposed ends mounted on the inner annular rims of the sidewalls of the respective cover means and the container portion with the holding means mounted on and between the first and second rod means wherein when the cover means is partially separated from the open end of the container portion to permit filling the dispenser, the holding means slides with respect to the first and the second rod means.

7. The dispenser of claim 1 wherein the resilient holding means is a coil spring means.

8. The dispenser of claim 1 wherein the cover means and the container portion are made of wood material.

9. The dispenser of claim 1 wherein the cover means and the container portion are made of a plastic material.

10. The dispenser of claim 1 wherein the cover means and the container portion are made of a metal material.

11. The dispenser of claim 1 wherein the cover means and the container portion are made of a glass material.

12. The dispenser of claim 1 wherein the holding means and the first anchor means provides for relative movement between the holding means and the first and second anchor means when the cover means is removed from the open end of the container portion.

* * * * *